United States Patent [19]

Hirano

[11] 4,357,854

[45] Nov. 9, 1982

[54] AUTOMATIC RHYTHM PERFORMANCE DEVICE

[75] Inventor: Hiroshi Hirano, Hamamatsu, Japan

[73] Assignee: Nippon Gakki Seizo Kabushiki Kaisha, Hamamatsu, Japan

[21] Appl. No.: 277,078

[22] Filed: Jun. 25, 1981

[30] Foreign Application Priority Data

Jun. 30, 1980 [JP] Japan ..... 55-88757

[51] Int. Cl.[3] ..... G10F 1/00

[52] U.S. Cl. ..... 84/1.03; 84/DIG. 12

[58] Field of Search ..... 84/1.03, 1.17, 1.24, 84/DIG. 22, DIG. 12

[56] References Cited

U.S. PATENT DOCUMENTS

| | | | |
|---|---|---|---|
| 3,707,594 | 12/1972 | Ichikawa | 84/1.03 |
| 4,089,245 | 5/1978 | Dietrich | 84/1.03 |
| 4,186,639 | 2/1980 | Robinson et al. | 84/1.03 |
| 4,256,005 | 3/1981 | Mishima | 84/1.03 |
| 4,314,493 | 2/1982 | Kondo | 84/1.03 |

*Primary Examiner*—B. Dobeck
*Assistant Examiner*—Forester W. Isen
*Attorney, Agent, or Firm*—Spensley, Horn, Jubas & Lubitz

[57] ABSTRACT

An automatic rhythm performance device is of a type in which an intro performance which is in a rhythm pattern different from a rhythm pattern of main performance to be performed amidst music progression is automatically provided at the start of an automatic rhythm performance. To provide the intro performance, this device has a memory for storing special rhythm patterns in addition to regular rhythm patterns for main performance. At the start of the automatic rhythm performance, this memory is made operable for a predetermined time period so that the intro performance is executed on the basis of intro pattern pulses read out from the memory. The intro performance is inhibited when "synchro start mode" which starts the automatic rhythm performance in synchronism with key depression is being selected.

9 Claims, 7 Drawing Figures

AUTOMATIC RHYTHM PERFORMANCE DEVICE

BACKGROUND OF THE INVENTION

This invention relates to an automatic rhythm performance device in which an automatic performance of a special rhythm pattern is automatically provided at the start of an automatic rhythm performance, i.e. just before the main automatic performance under the regular rhythm pattern, and particularly to an automatic rhythm performance device in which the operation of the automatic rhythm performance under the special rhythm pattern is automatically inhibited when the synchro-start function is being selected.

Automatic rhythm performance devices are generally provided with an "ordinary start" function which starts the automatic rhythm performance by turning on a rhythm start switch and a "synchro-start" function which starts the automatic rhythm performance in synchronism with the key depression.

In prior art, when the automatic rhythm performance is started in the "ordinary start" mode, that is, by turning on the rhythm start switch and a musical performance is carried out by depressing keys on the keyboard in tune with the automatic rhythm performance, the performer has to catch the correct key depression start timing by hearing the running rhythm pattern from the already-started automatic rhythm performance, and should start depressing the keys at the correct timing. However, the automatic rhythm performance in the prior art is merely the repetition of a certain length of performance under the predetermined rhythm pattern, and therefore the starting of the key depression in synchronism with the automatic rhythm performance is not only considerably difficult but also sounds unnatural.

In order to solve such problems, some automatic rhythm performance devices have been proposed in which an intro performance under the predetermined special pattern for the introduction to the music is automatically performed immediately before the main automatic rhythm performance. This intro performance works favorably when the automatic rhythm performance is started in the "normal start" mode by means of the manual start switch. However, it does not work favorably in terms of performance effect when the automatic rhythm performance is started in the "synchro-start" mode by means of a synchro-start switch. Since the "synchro-start" function atuomatically starts the automatic rhythm performance in synchronism with the key depression, the performer does not have to know the key depression start timing, and moreover an under a special rhythm pattern is not necessary and may even lower the performance effect with no possibility of improving the performance effect.

SUMMARY OF THE INVENTION

An object of the invention is to provide an automatic rhythm performance device which is free of the above-mentioned disadvantage when the synchro-start mode is selected.

The device according to the invention is constructed so as to automatically inhibit performing the intro performance when the synchro-start mode is selected.

DETAILED DESCRIPTION OF THE INVENTION

Figure 1:
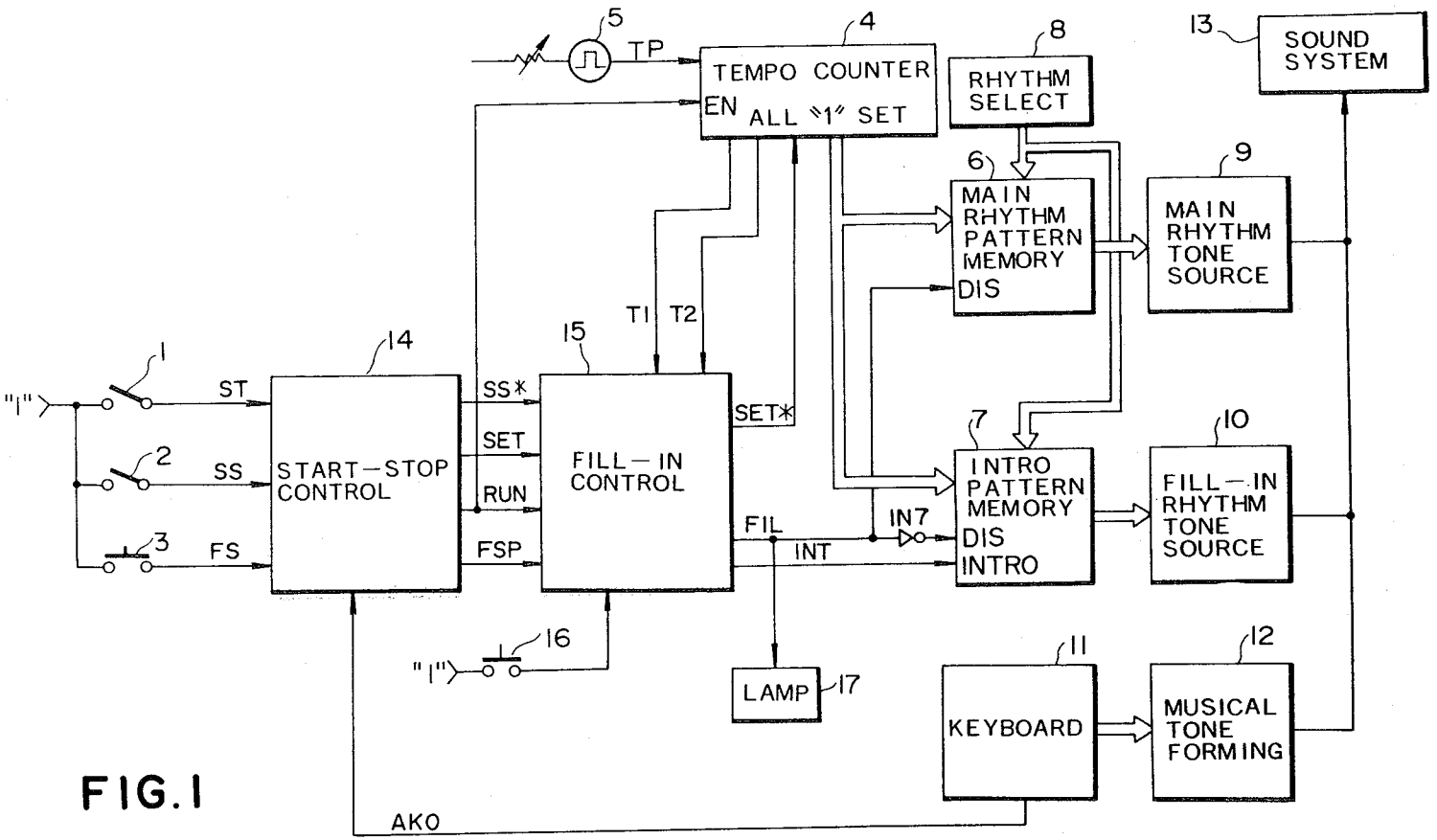
FIG. 1 is a block diagram of an embodiment of an automatic rhythm performance device according to this invention, which is employed in a keyboard electronic musical instrument.

Referring to FIG. 1, a start switch 1 is an ON-OFF type switch for selecting the "normal start" mode in which the automatic rhythm performance starts when this start switch is switched on, a synchro-start switch 2 is an ON-OFF type switch for selecting the "synchro-start" mode to start the automatic rhythm performance synchronized with the first key depression, and foot switch 3 is a self-return (non-lock) type switch to adjourn and resume the automatic rhythm performance in the course of the performance. Of these switches, the start switch 1 and the synchro-start switch 2 are, for example, provided on the panel unit (not shown) together with various switches of the electronic musical instrument, and the foot switch 3 is, for example, provided on an expression pedal (not shown) for the tone volume control.

A tempo counter 4 is for controlling the progress of the automatic performance and is driven by a tempo pulse TP generated by a variable tempo pulse oscillator 5. The parallel outputs (bits) of the tempo counter 4 is fed to a main rhythm pattern memory 6 and an intro pattern memory 7 as address signals.

The main rhythm pattern memory 6 is for storing main rhythm patterns corresponding to various rhythms for executing the automatic rhythm performance. This main rhythm pattern memory 6 receives as a static address the output of a rhythm select circuit 8 generating signals of the selected rhythm and the output of the tempo counter 4 as a dynamic address, to sequentially read out the pattern pulses based on the main rhythm pattern corresponding to the rhythm selected by the rhythm select circuit 8. The main rhythm pattern memory 6 may be composed using a read only memory (ROM).

Figure 2:
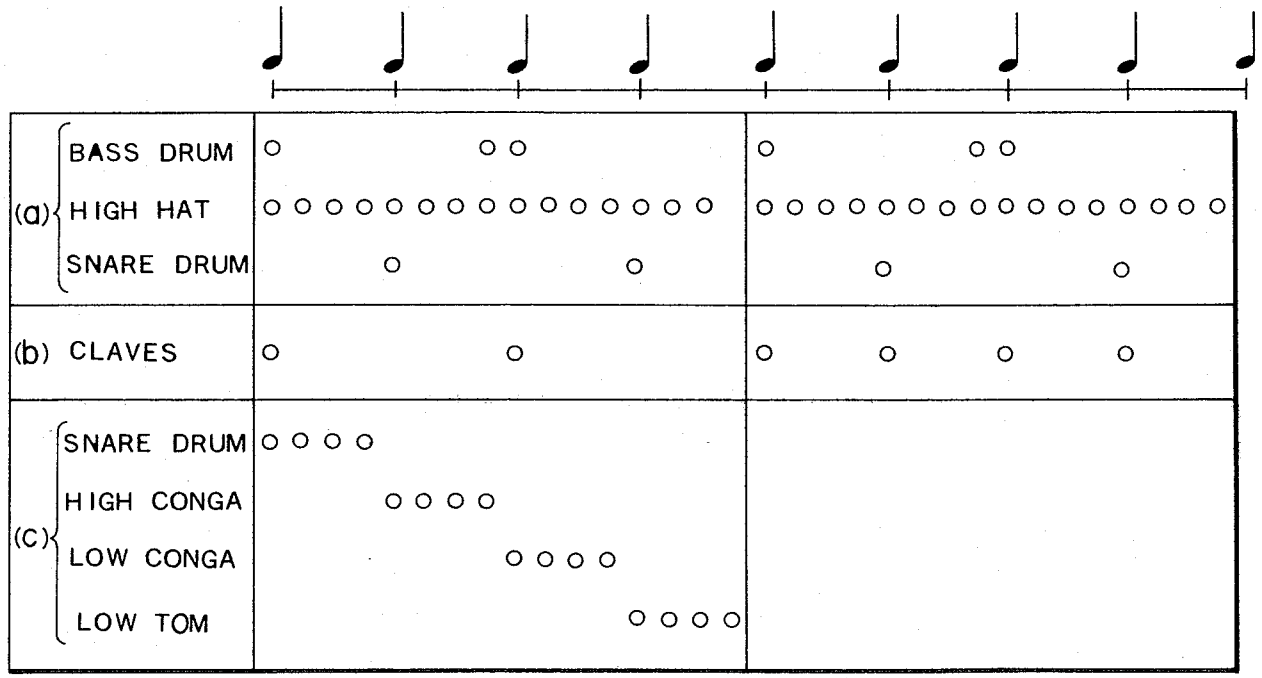
FIG. 2 is an explanatory drawing showing examples of a main rhythm pattern, an intro rhythm pattern and a resuming-intro rhythm pattern.

Referring to FIG. 2, "o" indicates the pattern pulse generation timing. An example of the main rhythm pattern being stored in the main rhythm pattern memory 6 is shown in (a) of FIG. 2. In this case, three-bit pattern pulses corresponding to a bass drum, high hat cymbal and snare drum are outputted from the main rhythm pattern memory 6.

The intro pattern memory 7 is for storing the intro pattern and a resuming-intro pattern used by the automatic rhythm performance device according to this invention. The intro pattern is a rhythm pattern of the introduction performed immediately before the start of the main automatic rhythm performance, and, for example, is composed of two half-notes in the first measure and four quarter-notes in the second measure with a sound of claves as shown in (b) of FIG. 2. On the other hand, the resuming-intro pattern is a rhythm pattern of the introduction performed immediately before the resumption (restart) of the automatic rhythm performance after adjournment (short break) thereof and, for example, is composed of consecutive beatings (in turn) of the snare drum, high conga drum, low conga drum, and low tom drum each comprising four sixteenth-notes as shown in (c) of FIG. 2. Any type of intro and resuming-intro patterns may be used provided that the tempo thereof and therefore the performance start timing are easy to be captured by a performer. As for the resuming-intro pattern, it should fit the flow of the performance. The intro patterns and the resuming-intro patterns are available corresponding to every type of rhythm such as waltz, mambo. Similar to the main rhythm pattern memory 6, the intro pattern memory 7 receives the output of the rhythm select circuit 8 and the output of the tempo counter 4 as a static address signal and a dynamic address signal respectively, and the pattern pulses based on the intro pattern or the resuming-intro pattern corresponding to a rhythm selected by the rhythm select circuit 8 are sequentially read according to the output of the tempo counter 4.

A signal applied to an intro selection terminal INTRO of the intro pattern memory 7 decides whether the pattern pulses based on the intro pattern or the pattern pulses based on the resuming-intro pattern are generated in the intro pattern memory 7. That is, if the signal fed to the terminal INTRO is "1", the intro pattern memory 7 generates pattern pulses based on the intro pattern, while when the signal is "0", pattern pulses based on the resuming-intro pattern are generated.

A main rhythm tone source circuit 9 receives pattern pulses based on the main rhythm pattern generated at the main rhythm pattern memory 6, and forms rhythm tones corresponding to the main rhythm pattern. That is, the main rhythm tone source circuit 9 has rhythm tone sources corresponding to various rhythm tones of musical instruments, and forms musical tone signals indicating the rhythm tones corresponding to the main rhythm pattern by sequentially start-stop controlling the tone source signals corresponding to various rhythm tones of musical instruments generated from the rhythm tone sources. This start-stop (keying or gating) control is made in accordance with the pattern pulses outputted from the main rhythm pattern memory 6.

A fill-in rhythm tone source circuit 10 receives pattern pulses based on the intro pattern or the resuming-intro pattern generated at the intro pattern memory 6, and forms a rhythm tone corresponding to the intro pattern or the resuming-intro pattern. The circuit configuration of this fill-in rhythm tone source circuit 10 may be the same as that of the main rhythm tone source circuit 9.

A keyboard circuit 11 includes a plurality of key switches respectively corresponding to keys on the keyboard, detects depressed keys, and generates the key information indicating depressed keys and an any-key-on signal AKO indicating that any of the keys is being depressed. The depressed key information generated at the keyboard circuit 11 is fed to a musical tone forming circuit 12, and a musical tone corresponding to the depressed key is formed.

A sound system 13 is for producing sounds of musical tones, and receives the outputs of the main rhythm tone source circuit 9, the fill-in rhythm tone source circuit 10 and the musical tone forming circuit 12, and produces rhythm tone sounds corresponding to the main rhythm pattern, rhythm tone sounds corresponding to the intro or resuming-intro pattern, and musical tone sounds corresponding to the depressed keys.

A start-stop control circuit 14 receives a signal ST outputted from the start switch 1, a signal SS outputted from the synchro start switch 2, a signal FS outputted from the foot switch 3 and an any-key-on signal AKO, and outputs a synchro start signal SS* indicating that the synchro start mode is being selected, a set signal SET for setting the tempo counter in the initial condition, a rhythm run signal RUN for causing the rhythm to run and a foot switch stop signal FSP indicating that the rhythm is in a break (standstill) according to the manipulation of the foot switch 3.

Figure 3:
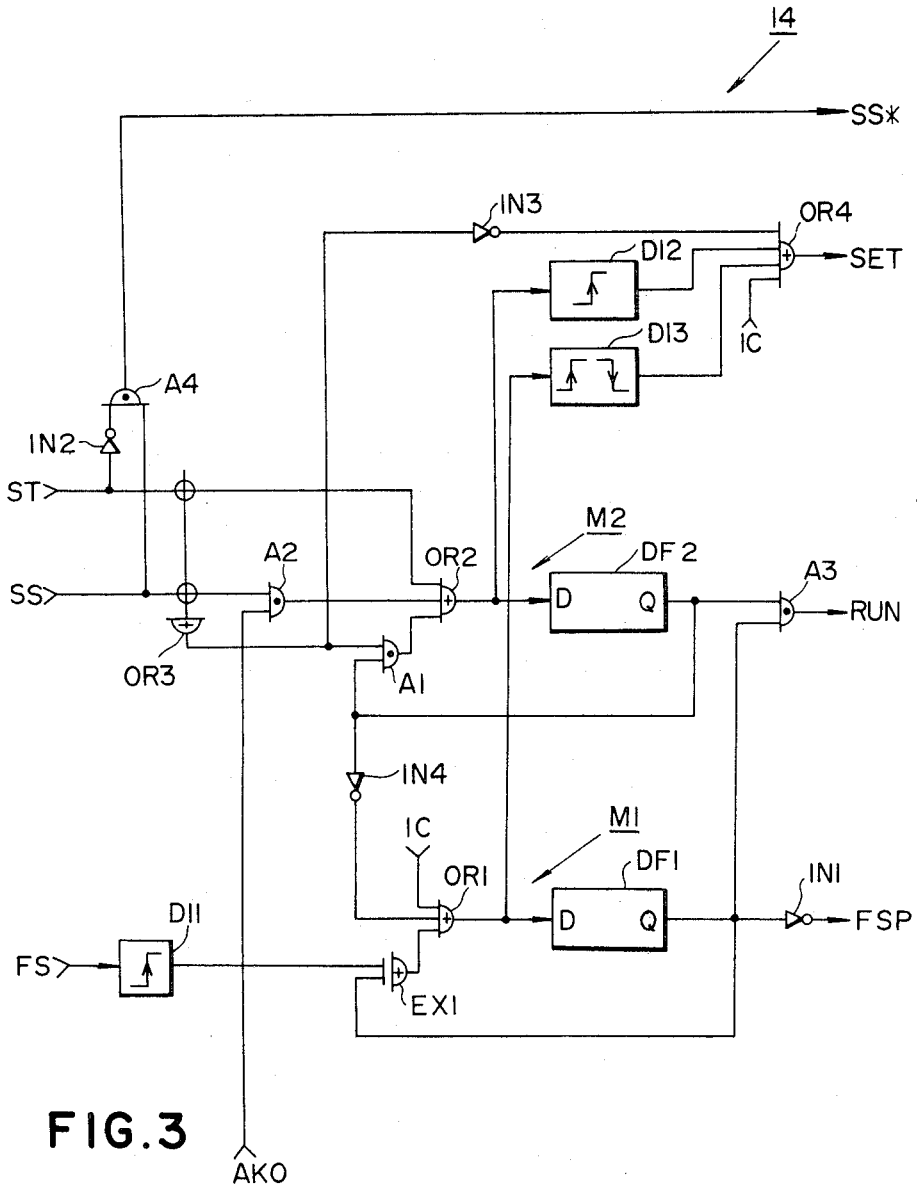
FIG. 3 is a detailed circuit diagram of an example of a start-stop control circuit in FIG. 1.

Referring to FIG. 3 which shows an example of detailed start-stop control circuit 14, an initial clear signal IC generated upon the power input is fed to a delay flip-flop DF1 through an OR circuit OR1, and a foot switch signal memory M1 comprising the delay flip-flop DF1, an exclusive OR circuit EX1 and the OR circuit OR1 is caused to memorize a signal "1". As a result, the output of the memory 1 (the output of the delay flip-flop DF1) becomes "1", and the foot switch stop signal FSP which is resulted from the inversion of the output of the memory 1 through an inverter IN1 becomes "0".

When the start switch 1 (FIG. 1) is turned on in this state, the signal ST becomes "1". The signal "1" is fed to a delay flip-flop DF2 through an OR circuit OR2, and is stored in a rhythm run signal memory M2 comprising the delay flip-flop DF2, an AND circuit A1 and the OR circuit OR2.

On the other hand, when the synchro start switch 2, (FIG. 1) is turned on, the signal SS becomes "1", and the signal "1" is fed to an AND circuit A2. To the other input of the AND circuit A2 has already been fed the any key on signal AKO outputted from the keyboard circuit 11 (FIG. 1). Accordingly, in the AND circuit A2 the AND condition is established synchronized with the key depression at the keyboard (not shown), and the AND circuit A2 outputs a signal "1". This signal "1" is fed to the flip-flop DF2 via the OR circuit OR2, and is stored in the rhythm run signal memory M2. That is, when the start switch 1 is turned on, the signal "1" is memorized by the rhythm run signal memory M2 synchronized with the operation of the start switch 1, while when the synchro start switch 2 is turned on, the signal "1" is memorized by the rhythm run signal memory 2 synchronized with the key depression at the keyboard. The output of this rhythm run signal memory M2 is fed to an AND circuit A3. To the other input of the AND circuit A3 has been fed the output of the foot switch signal memory M2. In this state, since the output of the memory 1 is "1", the AND circuit A3 has become ready to operate, and the rhythm run signal RUN from the AND circuit A3 becomes "1".

When the foot switch 3 (FIG. 1) is turned on with the rhythm run signal RUN being generated, the signal FS becomes "1". This signal "1" is fed to an exclusive OR circuit EX1 through a leading edge differentiation circuit DI1. Since the signal (the output of the delay flip-flop DF1) which is being fed to the other input of the exclusive OR circuit EX1 is "1", the output of the exclusive OR circuit EX1 becomes "0" and the signal stored in the foot switch signal memory M1 is cleared. As a result, the foot switch stop signal FSP which is resulted from the inversion of the output of the memory M1 through the inverter IN1 becomes "1", and the rhythm run signal RUN becomes "0" since the AND circuit A3 to which the output of the memory M1 is fed becomes non-operative.

When in this state the foot switch 3 is turned on again, the signal FS becomes "1", and a differentiated pulse is fed to the exclusive OR circuit FX1 from the leading edge differentiation circuit DI1. As a result, the output of the exclusive OR circuit EX1 is inverted, the signal "1" is stored in the foot switch signal memory M1, the foot switch stop signal FSP resulted from the inversion of the output of the memory M1 through the inverter IN1 becomes "0", the AND circuit A3 becomes operatable and the rhythm run signal RUN becomes "1".

That is, when the foot switch 3 is turned on during rhythm run (i.e., signal RUN="1"), the foot switch stop signal FSP becomes "1" and the rhythm run signal RUN becomes "0", while when the foot switch 3 is turned on during the rhythm stop state (i.e., signal RUN="0"), the foot switch stop signal FSP becomes "0" and the rhythm run signal RUN becomes "1".

If the synchro start switch 2 is ON and the start switch 1 is OFF, the synchro start signal SS* becomes "1". In this state, since the signal SS is "1" and the signal ST is "0", the AND condition at an AND circuit A4 to which the signal resulted from the inversion of the signal ST through an inverter IN2 and the signal SS are fed is established, and the output of the AND circuit A4 becomes "1". This signal "1" is sent out as the synchro start signal SS*. On the other hand, if the start switch 1 is OFF, the AND condition at the AND circuit A4 is not established even though the synchro start switch 2 is ON, and the synchro start signal SS* does not become "1". That is, the start-stop control circuit 14 is so constructed that the selection of the "ordinary start" mode by the start switch 1 has a priority to the selection of the "synchro start" mode by the synchro start switch 2.

The signal resulted from the inversion, through an inverter IN3, of the output of an OR circuit OR3 that takes the OR condition of the signals ST and SS, the output signal of an differentiation circuit D12 that conducts leading edge differentiation on the output signal of the OR circuit OR2 composing the rhythm run signal memory M2, the output signal of a differentiation circuit D13 that conducts leading and trailing edge differentiation on the output signal of the OR circuit OR1 composing the foot switch memory M1, and the initial clear signal IC is output as set signals SET through an OR circuit OR4.

That is, the set signal SET becomes "1" in the following cases:

(1) Before the automatic rhythm performance starts and both of the start switches 1 and 2 are OFF,
(2) At the start of the automatic rhythm performance by turning the start switch 1 on,
(3) At the start of the automatic rhythm performance with the synchro start switch 2 being ON and the any-key-on signal AKO being "1",
(4) At the time when the automatic rhythm performance is interrupted by turning the foot switch 3 on,
(5) At the time when the automatic rhythm performance is resumed by turning the foot switch 3 on, and
(6) Upon power input.

It is also constructed so that in a state where the output of the rhythm run signal memory M2 is being fed to the OR circuit OR1 of the foot switch signal memory M1 through an inverter IN4, the signal "1" is memorized by the foot switch signal memory M1 when the signal stored in the rhythm run signal memory M2 is cleared (when both the start switch 1 and the synchro start switch 2 are turned off). The above is required to make the AND circuit A3 in the operatable status so as to be ready for the case when the start switch 1 or the synchro start switch 2 is turned on.

The rhythm run signal RUN outputted from the start-stop control circuit 14 is fed to the enable terminal EN of the tempo counter 4. That is, if the rhythm run signal RUN is "1", the tempo counter 4 becomes operatable and the automatic rhythm performance progresses, while if the rhythm run signal RUN is "0", the tempo counter 4 becomes non-operative and the automatic rhythm performance is stopped.

The synchro start signal SS*, set signal SET, rhythm run signal RUN and the foot switch stop signal FSP outputted from the start-stop control circuit 14 are fed to a fill-in control circuit 15.

The fill-in control circuit 15 controls the providing of the automatic rhythm performance based on the intro pattern at the start of the automatic rhythm performance and the automatic rhythm performance based on the resuming-intro pattern at the resumption after adjournment of the automatic rhythm performance.

Figure 4:
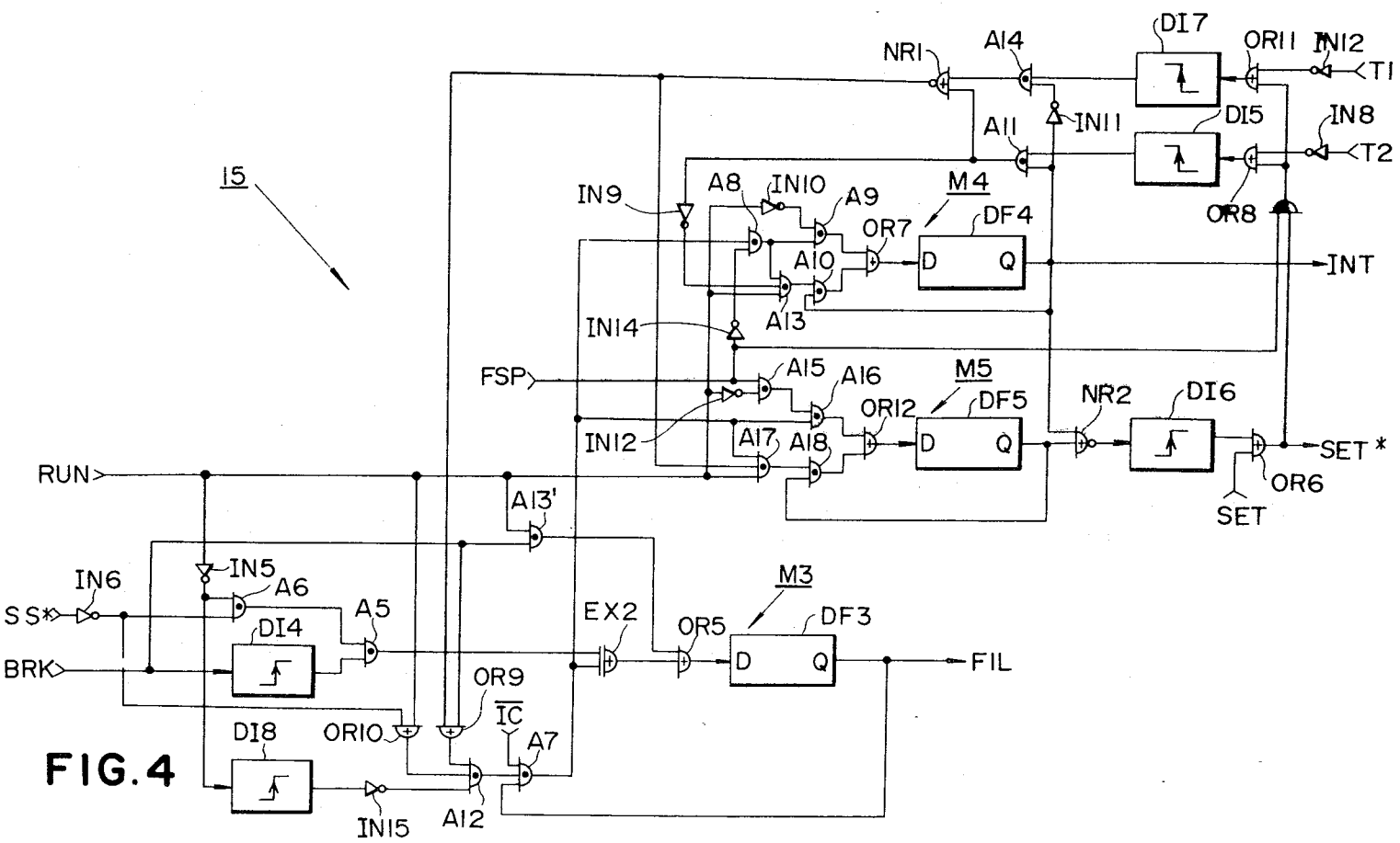
FIG. 4 is a detailed circuit diagram of an example of a fill-in control circuit in FIG. 1

Referring to FIG. 4, the providing of the automatic rhythm performance based on the intro pattern and the automatic rhythm performance based on the resuming-intro pattern are controlled by the actuation of a intro performance select switch 16. This intro performance select switch 16 is of the self-turn type, and is, for example, provided on the panel unit of the electronic musical instrument.

The operation when a rhythm is started by turning on the switch 16 and then the start switch 1 is now described.

As the switch 16 is turned on, the resuming-intro signal BRK becomes "1", and the signal "1" is fed to an AND circuit A5 through a leading edge differentiation circuit D14. To the other input of the AND circuit A5 is fed in advance the output of an AND circuit A6 which takes the AND condition of the signal resulted from the inversion of the rhythm run signal RUN through an inverter IN5 and the signal resulted from the inversion of the synchro start signal SS* through an inverter IN6. In this case, since the rhythm run signal RUN is "0" and the synchro start signal SS* is "0", the output of the AND circuit A6 is "1", and the AND circuit A5 is operatable. Accordingly, the signal outputted from the differentiation circuit D14 based on the signal BRK is fed to a delay flip-flop DF3 through an exclusive OR circuit EX2 and on OR circuit OR5 via the AND circuit A5.

The output of the delay flip-flop DF3 is fed to the input of the same delay flip-flop DF3 through an AND circuit A7, the exclusive OR circuit EX2, and the OR circuit OR5 forming a fill-in memory M3 which memorizes the signal fed to the delay flip-flop DF3. Since the output of the AND circuit A7 is "0" because the signal stored in the fill-in memory M3 is cleared by the initial clear signal $\overline{IC}$ upon power input, the exclusive OR circuit EX2 applies the signal fed from the AND circuit A5 directly to the OR circuit OR5.

The output of the fill-in memory M3 is sent out as a fill-in signal FIL, is fed to the disenable terminal DIS of the main rhythm pattern memory 6 (FIG. 1), and is also fed to the disenable terminal of the intro pattern memory 7 after being inverted through an inverter IN7. As a result, the main rhythm pattern memory 6 becomes non-operative, and the intro pattern memory 7 becomes operatable. However, since the rhythm run signal RUN outputted from the start-stop control circuit 14 is still "0" and the tempo counter 4 is non-operative, the automatic rhythm performance is not started. In this state, a set signal SET is generated at the start-stop control circuit 14, is fed to the tempo counter 4 as a set signal SET*, and sets the content of the tempo counter 4 to all "1". Upon being generated at the fill-in control circuit 15, the fill-in signal FIL is applied to a lamp 17, causing the lamp 17 to light.

Then, as the start switch 1 is turned on, the rhythm run signal RUN generated at the start-stop control circuit 14 becomes "1", and AND circuits A13 and A10 become operatable. In this state, since the output of an AND circuit A12 has already been fed to a flip-flop DF4 through AND circuits A8 and A9 and an OR circuit OR7 with the rhythm run signal RUN in the "0" state, the rhythm run signal RUN becomes "1" and the signal "1" is memorized by the intro memory M4 at the same time. The output of the intro memory M4 is fed to the intro selection terminal INTRO of the intro pattern memory 7 as an intro signal INT, which changes the pattern pulse to be read from the intro pattern memory 7 to one based on the intro pattern.

When the rhythm run signal RUN outputted from the start-stop control circuit 14 becomes "1", the tempo counter 4 becomes operatable, and the automatic rhythm performance is started. In the state, since the main rhythm pattern memory 6 is non-operative and the intro pattern memory 7 has been switched so as to read the pattern pulse based on the intro pattern, the pattern pulses based on the intro pattern as shown in (b) of FIG. 2 are sequentially outputted, musical tone signals exhibiting the corresponding rhythm are formed at the fill-in rhythm tone source 10 based on these pattern pulses, and the automatic rhythm performance based on the intro pattern is executed.

Figures 5A, 5B, 5C:
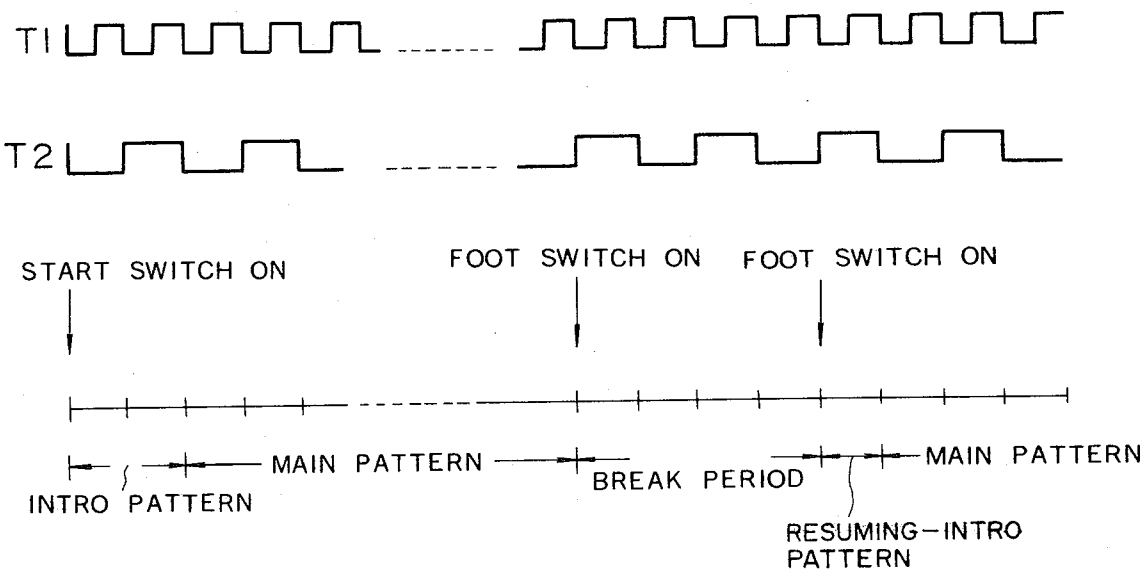
FIG. 5 is a timing chart illustrating an operation of the embodiment shown in FIG. 1.

The automatic rhythm performance based on this into pattern is switched to the automatic rhythm performance based on the main rhythm pattern after its two-measure long performance. That is, two-measure cycle pulses as shown in FIG. 5 (b) outputted from the tempo counter 4 are fed to a differentiation circuit D15 through an inverter IN8 and an OR circuit OR8, subjected to the leading edge differentiation, and are fed to an AND circuit A11 which has been made operatable by the output of the intro memory M4. The output of this AND circuit A11 is inverted at a NOR circuit NR1, fed to the AND circuit A7 through an OR circuit OR9 and the AND circuit A12, and clears the signal stored in the fill-in memory M3. On the other hand, the output of the AND circuit A11 is inverted at an inverter IN9, is fed to an AND circuit A10 through the AND circuit A13, and clears the content of the intro memory M4. As the fill-in memory M3 is cleared, the fill-in signal FIL becomes "0", the intro pattern memory 7 becomes non-operative accordingly, and the main rhythm pattern memory 6 becomes operatable. When the intro memory M4 is cleared, a pulse signal is outputted from a leading edge differentiation circuit DI6 which receives the output of the intro memory M4 reverted at the OR circuit OR2 and is fed to the tempo counter 4 as a set signal SET* via an OR circuit OR6, causing the content of the tempo counter 4 to be set to all "1".

Accordingly, the tempo count 4 starts counting from the initial condition, and thereafter the automatic rhythm performance is executed according to the pattern pulses based on the main rhythm pattern read from the main rhythm pattern memory 6. That is, in this case, when the start switch 1 is turned on, the automatic rhythm performance is executed based on the intro pattern for the length of two measures and then shifted to one based on the main rhythm pattern.

The case when the synchro start switch 2 is turned on after the operation of the intro performance select switch 16 is now described.

When the intro performance select switch 16 is turned on, the resuming-intro signal BRK becomes "1" and is stored in the fill-in memory M3 through the leading edge differentiation circuit D14, the AND circuit A5, the exclusive OR circuit EX2 and the OR circuit OR5 similar to the case mentioned above. On the other hand, when the synchro start switch 2 is turned on and the synchro start signal SS* outputted from the start-stop control circuit 14 becomes "1", the signal SS* is inverted at the inverter IN6, is fed to the AND circuit A7 through an OR circuit OR10 and an AND circuit A12, and the content of the fill-in memory M3 is cleared. As a result, the fill-in signal FIL becomes "0", the intro pattern memory 7 becomes non-operative and the main rhythm pattern memory 6 becomes operatable. Accordingly, as the rhythm run signal RUN becomes "1" synchronized with the key depression at the keyboard, the automatic performance is executed according to the pattern pulses based on the main rhythm pattern read from the main rhythm pattern memory 6.

That is, when the synchro start switch 2 is turned on subsequent to the operation of the switch 16, the performance is started from the automatic rhythm performance based on the main rhythm pattern, and the automatic rhythm performance based on the intro pattern is not executed.

When the switch 16 is turned on after the operation of the synchro switch 2, the output of the AND circuit A6 receiving the synchro start signal SS* inverted through the inverter IN6 becomes "0", thereby the AND circuit A5 becomes non-operative, and therefore the signal "1" is not memorized by the fill-in memory M3 even when the switch 16 is turned on. Accordingly, in this case, the automatic rhythm performance based on the main rhythm pattern is started synchronized with the key depression at the keyboard and as same in the above the automatic rhythm performance based on the intro pattern is not executed.

Now is described the operation of the case in which the switch 16 is turned on during the automatic rhythm performance (i.e., RUN="1").

When the switch 16 is turned on amidst the automatic rhythm performance with the rhythm run signal RUN being "1", the AND condition of an AND circuit A13', which takes the AND condition of the resuming-intro signal BRK and the rhythm run signal RUN, is established, and thereby a signal "1" is outputted. The output of this AND circuit A13' is fed to the delay flip-flop DF3 via the OR circuit OR5. As a result, the signal "1" is memorized by the fill-in memory M3, and the fill-in signal FIL becomes "1".

When the fill-in signal FIL becomes "1", similar to the above-mentioned case, the main rhythm pattern memory 6 becomes non-operative, and the intro pattern memory 7 becomes operatable. In this case, since the AND circuit A9 receiving the rhythm run signal RUN being inverted at an inverter IN10 is already non-operative, the signal "1" is not stored in the intro memory M4, and the intro signal INT is "0". As a result, the intro pattern memory 7 reads out the pattern pulses based on the resuming-intro pattern and the automatic rhythm performance according to the resuming-intro pattern as shown in (*c*) of FIG. 2, for example, is executed.

When the signal "1" is not stored in the intro memory M4, the AND circuit A14 receiving the output of the intro memory M4 inverted through an inverter IN11 is operatable. To this AND circuit A14 are fed a one-measure cycle signal T1 as shown in FIG. 5(*a*) from the tempo counter 4 through an inverter IN12, an OR circuit OR11 and a leading edge differentiation circuit D17, and the AND circuit A14 outputs a pulse signal at the end of each measure. This pulse signal is fed to the AND circuit A7 through the NOR circuit NR1, the OR circuit OR9 and the AND circuit A12, and resets the fill-in memory M3. As a result, the fill-in signal FIL becomes "0", the intro pattern memory 7 becomes non-operative, the main rhythm pattern memory 6 becomes operable and the performance is shifted to the automatic rhythm performance based on the main rhythm pattern.

That is, when the switch 16 is turned on in the rhythm run state, the performance changes to the automatic rhythm performance based on the resuming-intro pattern synchronized with the ON timing of the switch 16, and returns to the automatic rhythm performance based on the main rhythm pattern synchronized with the end of that measure. In this case, the inserted time of the automatic rhythm performance based on the resuming-intro rhythm pattern varies with the ON timing of the switch 16. For example, when the switch 16 is turned on at the head of the measure, the automatic rhythm performance based on the resuming-intro pattern for the length of just one measure is performed. The resuming-intro signal BRK is fed to the OR circuit 9 for the purpose to make storage of the signal "1" to the fill-in memory M3 possible by setting the AND circuits A12 and A7 operable when the ON timing of the switch 16 coincides with the head of the measure.

The following is a description of operation in the case that the automatic rhythm performance is restarted by turning on the restart switch 16 and then turning the foot switch 3 on subsequent to an interruption of the automatic rhythm performance by turning the foot switch 3 on.

When the foot switch 3 is turned on during the automatic rhythm performance (i.e., RUN="1"), the content of the foot switch signal memory M1 (FIG. 3) is cleared, the foot switch stop signal FSP becomes "1", the rhythm run signal RUN becomes "0" and the automatic rhythm performance stops. When the rhythm run signal RUN becomes "0", a pulse signal is generated at a leading edge differentiation circuit D18 receiving the rhythm run signal RUN inverted at the inverter IN5, and is fed to the AND circuit A12 via an inverter IN15. As a result, the content of the fill-in memory M3 is cleared if it still remains in the memory M3. When the switch 16 is turned on in this state, the resuming-intro signal BRK becomes "1" and is fed to the delay flip-flop DF3 through the leading edge differentiation circuit D14, the AND circuit A5, the exclusive OR circuit EX2 and the OR circuit OR5, and then the signal "1" is stored in the fill-in memory M3. As a result, the fill-in signal FIL becomes "1", thereby making the rhythm pattern memory 6 non-operative and the intro pattern memory 7 operatable.

In the meantime the foot switch stop signal FSP is fed to an AND circuit A15. To the other input of the AND circuit A15, the output of an inverter IN13 which is the inversion of the rhythm run signal RUN has already been fed. Accordingly, in this case, the AND condition at the AND circuit A15 is established and the signal "1" becomes outputted. The signal "1" thus outputted is fed to an AND circuit A16, making the AND circuit A16 operatable. Accordingly, the output of the AND circuit A7 is fed to a delay flip-flop DF5 composing a resuming-intro memory M5 through the AND circuit A16 and an OR circuit OR12. However, since the AND circuit A8 to which a signal resulted from the inversion at an inverter IN14 of the foot switch stop signal FSP is fed is in the non-operative state, the output of the AND circuit A7 is not fed to the delay flip-flop DF4.

When the foot switch 3 is turned on again, the signal "1" is memorized at the foot switch signal memory M1 (FIG. 3), the foot switch stop signal FSP becomes "0" and then the rhythm run signal RUN becomes "1". As the rhythm run signal RUN becomes "1". AND circuits A17 and A18 become operable, and the signal "1" is memorized at the resuming-intro memory M5. However, the signal "1" is not stored in the delay flip-flop DF4 since the output of the AND circuit A7 has not been fed to the delay flip-flop DF4, and the intro signal INTRO is "0". The set signal SET outputted from the start-stop control circuit 14 becomes "1" synchronized with the ON timing of the foot switch 3 and is fed to the tempo counter 4 via the OR circuit OR6, thereby setting the content of the tempo counter 4 to all "1".

Accordingly, as the rhythm run signal RUN becomes "1", pattern pulses based on the resuming-intro pattern as shown in (*c*) of FIG. 2 are outputted from the intro pattern memory 7, and the automatic performance based on the restart-intro pattern is executed according to the pattern pulses.

When the automatic rhythm performance based on this resuming-intro pattern is executed for the time length of one measure, a pulse signal is outputted from the AND circuit A14, the content of the fill-in memory M3 is reset by this pulse signal and as a result, the fill-in signal FIL becomes "0", thus changing the performance to the automatic performance based on the main rhythm pattern. At the same time, the pulse signal from the AND circuit A14 is fed to the AND circuit A18 through the NOR circuit NR1 and the AND circuit A17, thus making the AND circuit A18 non-operative. As a result, the content of the resuming-intro memory M5 is cleared. As the content of the resuming-intro memory M5 is cleared, a pulse signal is generated from the leading edge differentiation circuit D16 to which a signal resulted from the inversion of the output of the resuming-intro memory M5 at a NOR circuit NR2 is fed, is fed to the tempo counter 4 as the set signal SET* via the OR circuit OR6, thus setting the content of the tempo counter 4 to all "1". Therefore, the automatic rhythm performance based on the main rhythm pattern is started from the initial condition by taking the place of the automatic rhythm performance based on the resuming-intro pattern.

As described above, when the automatic rhythm performance is resumed by turning the intro performance select switch 16 on and subsequently turning the foot switch 3 on after the automatic rhythm performance is interrupted the automatic rhythm performance based on the resuming-intro pattern is executed for the length of one measure as shown in FIG. 5(*c*) immediately before the automatic rhythm performance based on the main pattern takes over.

In the above case, when the synchro start switch 2 is ON and the synchro start signal SS* is generated from the start-stop control circuit 14, the signal "1" is not memorized at the fill-in memory M3 since the output of the AND circuit A6 is "0" and the AND circuit A5 is non-operative even when the intro performance select switch 16 is turned on and, the resuming-intro signal BRK becomes "1", and therefore the automatic rhythm performance based on the resuming-intro pattern is not executed at the resumption of the automatic rhythm performance.

The device may be so constructed as to permit the execution of the automatic rhythm performance in the above case. This can be achieved by using the signal $\overline{\text{RUN}}$ resulted from the inversion of the rhythm run signal RUN, the foot switch stop signal FSP, and the synchro start signal SS* as a substitute for the input signal of the AND circuit A6 shown in FIG. 4.

In the above embodiment, the main rhythm tone source circuit 9 and the fill-in rhythm tone circuit source circuit 10 are provided separately corresponding to the main rhythm pattern memory 6 and intro pattern memory 7 respectively. However, these two circuits may be constructed into one circuit to be used in common.

As apparent from the above description, in an automatic rhythm performance device according to this invention, the intro performance is executed only when the "ordinary start" mode in which the automatic rhythm performance is started by the operation of the start switch, is selected. In other words, the intro performance is in no case executed when the "synchro start" mode is selected since the device automatically inhibits the execution of the intro performance when the "synchro start" mode is being selected.

I claim:

1. In combination with a synchro start automatic rhythm performance device intro control means for automatically providing an intro performance based on a predetermined pattern at the start of an automatic rhythm performance, and inhibition means for inhibiting the operation of said intro control unit when said start of the automatic rhythm performance is a synchro start in which the automatic rhythm performance is started in synchronism with key depression.

2. An automatic rhythm performance device according to claim 1, wherein said intro control means includes an intro performance ready memory for storing an intro signal indicating that the intro performance is being selected, and the intro performance is enabled when said intro signal is stored in said intro performance ready memory.

3. An automatic rhythm performance device according to claim 2, wherein said inhibition means inhibits the storage of the intro signal into said intro performance ready memory by the operation of a synchro start switch which selects synchro start mode.

4. An automatic rhythm performance device according to claim 1, wherein said intro control means includes setting means for setting said automatic rhythm performance to an initial condition at the termination of the intro performance based on an intro pattern.

5. An automatic rhythm performance device according to claim 1, wherein said intro control means comprises:

an intro performance ready memory for storing the intro signal by the operation of an intro switch and for holding the intro signal thus stored for a period required for the intro performance, an intro pattern memory for storing intro pattern corresponding to intro performances, an intro performance tone source circuit for generating musical tone source signals for the intro performance corresponding to intro pattern pulses read out from said intro pattern memory, and control means for enabling the operation of said intro performance tone source circuit and at the same time for inhibiting the start of said automatic rhythm performance during the period when the intro signal is being stored in the intro performance ready memory.

6. An automatic rhythm performance according to claim 2, wherein said intro performance ready memory comprises:

a first memory for storing the intro signal by the operation of an intro switch, and a second memory for storing the intro signal stored in said first memory in synchronism with the operation of a start switch, and said control means enables the operation of said intro performance circuit, when the intro signal is being selected in both said first and second memories.

7. An automatic rhythm performance device according to claim 6, wherein said first and second memories are cleared at timings corresponding to the termination of every bar interval under the condition that the intro performance is in progress.

8. An automatic rhythm performance device according to claim 5, wherein said inhibition means clears the intro signal stored in said first memory by the operation of the synchro-start switch.

9. In an electronic musical instrument including keys for playing musical notes, an automatic rhythm performance device comprising:

a first automatic performance circuit for rendering a first automatic rhythm performance under a first rhythm pattern;

a second automatic performance circuit for rendering a second automatic rhythm performance under a second rhythm pattern;

a start-stop control circuit including a start switch and being connected to said keys and to said first and second automatic performance circuits for controlling start and stop of said first and second automatic performance circuits in at least two modes, one being a first mode wherein automatic performance starts, upon actuation of said start switch, with said first automatic rhythm performance for a predetermined limited time period and thereafter is succeeded by said second automatic rhythm performance, whereas the other being a second mode wherein automatic performance starts, in synchronism with the first actuation of any of said keys, with said second automatic rhythm performance.

* * * * *